United States Patent [19]

Mose et al.

[11] 4,299,681

[45] Nov. 10, 1981

[54] HYDROCHLORIC ACID ELECTROLYZER

[75] Inventors: Luciano Mosé, Dortmund; Helmuth Schurig, Holzwickede; Bernd Strasser, Hamm, all of Fed. Rep. of Germany

[73] Assignee: UHDE GmbH, Dortmund, Fed. Rep. of Germany

[21] Appl. No.: 118,560

[22] Filed: Feb. 4, 1980

[30] Foreign Application Priority Data

Mar. 2, 1979 [DE] Fed. Rep. of Germany ..... 2908269

[51] Int. Cl.[3] ..... C25B 9/04

[52] U.S. Cl. ..... 204/255; 204/257; 204/262; 204/274; 204/279

[58] Field of Search ..... 204/253–258, 204/263–266, 274, 128, 262, 279

[56] References Cited

U.S. PATENT DOCUMENTS

| | | | |
|---|---|---|---|
| 3,236,760 | 2/1966 | Messner | 204/256 |
| 3,673,076 | 6/1972 | Juckniess | 204/256 |
| 4,201,651 | 5/1980 | Themy | 204/274 X |

FOREIGN PATENT DOCUMENTS

| | | | |
|---|---|---|---|
| 2816152 | 10/1979 | Fed. Rep. of Germany | 204/128 |
| 1570279 | 6/1969 | France | 204/256 |
| 2410059 | 7/1979 | France | 204/257 |

*Primary Examiner*—Donald R. Valentine

*Attorney, Agent, or Firm*—Wilson, Fraser, Barker & Clemens

[57] ABSTRACT

Hydrochloric acid electrolyzers serve to decompose hydrochloric acid to hydrogen and chlorine with the aid of electric current.

3 Claims, 1 Drawing Figure

HYDROCHLORIC ACID ELECTROLYZER

SUMMARY OF THE INVENTION

The invention relates to a hydrochloric acid electrolyzer comprising a plurality of vertical bipolar electrodes in electrode frames, with diaphragms arranged between the electrodes such as to form anolyte and catholyte chambers, the filter press type electrolyzer being provided at each end with a pressure plate, with at least one insulated current conducting element penetrating the pressure plate, the current conducting element being joined to the first or last electrode, respectively, the electrolyzer being equipped with inlet and outlet facilities for the electrolytes and products, said inlets and outlets communicating with ducts arranged in the electrode frames.

A stuffing box arranged in each pressure plate constitutes the passage for the current conducting element through and a seal against the pressure plate. Like the electrodes, the current conducting element is made of graphite and screwed into the first or last electrode, respectively. A small gap remains between the pressure plate and the adjacent electrode, the gap width being the same as the thickness of the gasket between the electrodes. In order to prevent an excessive pressure from building up due to the possible formation of gas, a relief aperture is arranged in the first and last electrode communicating between the gap and the next electrolyte chamber.

During the operation of said electrolyzers, disturbances frequently occur in the current conducting element. This element becomes so hot that the electrolyzer has to be shut down, despite the fact that the current conducting element was sized for a low current density. On dismantling such an electrolyzer it is found that, due to hairline cracks in the current conducting element, the current density is excessive in places, thus causing overheating. The temperature rises up to 100° C. and this results in the electrolyte boiling.

The aim of the invention is to avoid disturbances at the current conducting elements and to prevent the temperature from increasing.

The aim is met according to the invention in that an electrolyte flow space is provided between each pressure plate and the adjacent electrode, and that feed facilities for anolyte and catholyte terminate in said electrolyte flow space, the electrolyte flow spaces communicating with the inlet ducts in the electrode frames.

According to a further embodiment of the invention, the feed facilities for anolyte and catholyte are arranged in the electrolyte flow spaces above the current conducting elements and the inlet ducts in the lower part of the electrode frames.

DETAILED DESCRIPTION OF THE PREFERRED EMBODIMENT

Figure 1:
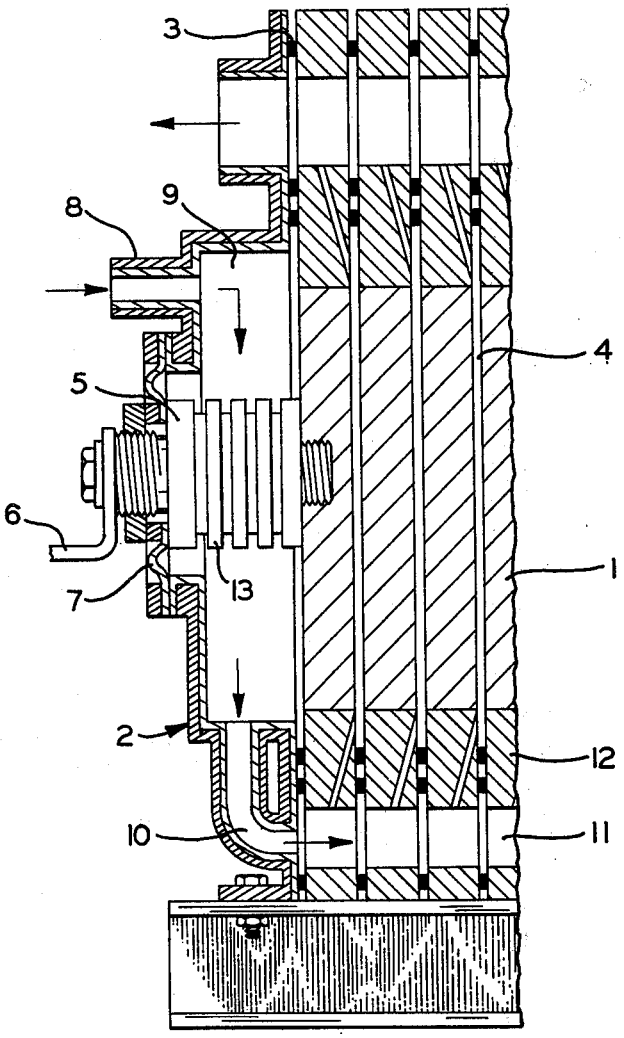
FIG. 1 is a fragmentary elevational view in section illustrating one end portion of an electrolyzer embodying the features of the invention.

The invention may be illustrated by an example. A plurality of electrodes 1, which are made of graphite in in this case, are compressed in the manner of a filter press by two pressure plates 2 arranged on either side of the plurality of electrodes. The electrodes 1 are sealed against each other by means of sealing rings 3 placed between the electrode frames 12 thus forming the electrolyte spaces 4 between the electrodes. The current conducting elements 5 with bus bar 6 are installed in the pressure plates 2 by being screwed into the first or last electrode, respectively, while their free movement within the pressure plate 2 is ensured by a membrane type seal 7. The pressure plate 2 features inlet or outlet means 8 for the electrolyte and is constructed to leave an electrolyte flow space 9 of effective width between the inlet or outlet means 8 and the adjacent electrodes 1. The feed facilities 8, e.g. a flanged connection, is located above the current conducting element 5 to permit the electrolyte to flow from top to bottom along the current conducting element 5, thus providing adequate cooling in the event of a temperature rise. The fresh electrolyte flows through a duct 10 in the lower part of the pressure plate 2 and thence into the distribution chambers 11 of the electrode frames 12. The current conducting element on the opposite side of the hydrochloric acid electrolyzer is basically of the same construction and arrangement and is thus also cooled.

The invention permits trouble-free operation as regards the current conducting elements. If a hairline crack should nevertheless occur in the current conducting elements resulting in a high current density, overheating will be avoided by virtue of the cooling effect of the electrolyte flowing through the electrolyte flow space. To enhance heat transfer from the current conducting element 5 to the electrolyte the current connecting element 5 may include cooling fins 13, for increasing its surface area.

We claim:

1. A hydrochloric acid electrolyzer comprising a plurality of bipolar electrodes in electrode frames, diaphragms arranged between the electrodes defining anolyte and catholyte chambers, a pressure plate at each end of the electrolyzer, at least one insulated current conducting element penetrating each pressure plate and connected to the adjacent electrode, an electrolyte flow space defined between each pressure plate and the adjacent electrode, electrolyte distribution chambers defined within said frames, said electrolyte distribution chambers being in fluid communication with one end of each of said electrolyte flow spaces, and inlet and outlet means to said electrolyte flow space, said inlet and outlet means spaced from said electrolyte distribution chambers, whereby all electrolyte flows through said electrolyte flow spaces.

2. Hydrochloric acid electrolyzer according to claim 1, characterized in that the inlet and outlet means for anolyte and catholyte terminate in the electrode flow spaces above the current conducting elements and that the distribution chambers are arranged in the lower part of said electrode frames.

3. Hydrochloric acid electrolyzer according to claims 1 or 2, characterized in that the current conducting elements are provided with cooling fins at least in the area of the electrolyte flow space.

* * * * *